United States Patent [19]

Rehder et al.

[11] 3,947,714

[45] Mar. 30, 1976

[54] METAL IODIDE VAPOUR DISCHARGE LAMP

[76] Inventors: Ludwig Rehder, Rathausstrasse 33; Renate Kaiser, Wilhelmstrasse 44; Roland Lorenz, Bruckstrasse 19, all of 51 Aachen, Germany

[22] Filed: Nov. 25, 1974

[21] Appl. No.: 527,043

[30] Foreign Application Priority Data

Dec. 21, 1973 Germany ..... 2363843

[52] U.S. Cl. ..... 313/225; 313/228

[51] Int. Cl.[2] ..... H01J 61/18

[58] Field of Search ..... 313/225, 228, 227, 223

[56] References Cited

UNITED STATES PATENTS 3,538,373 11/1970 Van Der Linden et al..... 313/223 X

*Primary Examiner*—R. V. Rolinec

*Assistant Examiner*—Darwin R. Hostetter

[57] ABSTRACT

To obtain an iron spectral lamp iron iodide and hydrogen are introduced into a discharge lamp.

5 Claims, 1 Drawing Figure

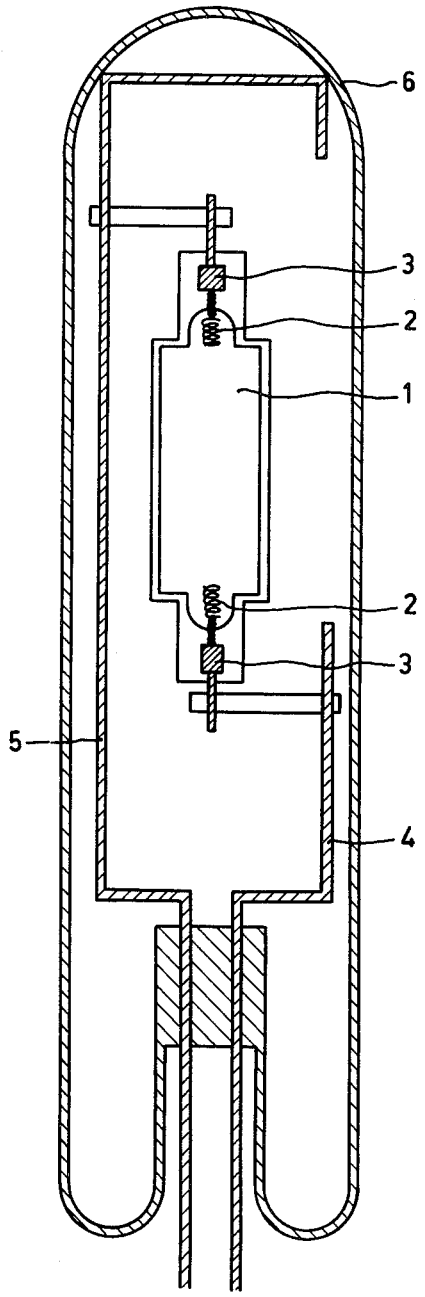
6
3
2
1
2
3
5
4

METAL IODIDE VAPOUR DISCHARGE LAMP

The invention relates to a metal iodide vapour discharge lamp having a discharge vessel which contains a noble gas for starting, a metal and iodine in an amount equivalent to that of the metal.

The known lamps of this type, which predominantly are high-pressure lamps, contain as the metal, for example, one or more of the elements thallium, indium, sodium and the rare earth elements. These lamps further substantially always contain mercury as a buffer gas.

It is an object of the present invention to provide an iron spectral lamp which is suitable for use as a wavelength standard on the basis of the iron line spectrum. Known iron spectral lamps use an open iron arc. However, such arcs tend to be unstable and unless used in an inert atmosphere have an iron line spectrum on which disturbing molecule bands are superposed. Furthermore several designs of iron hollow cathode lamps are known which, however, have a low overall luminous efficiency and require complicated apparatus for their operation.

According to the invention a discharge lamp of the abovedescribed type may be designed as an iron spectral lamp if iron iodide ($FeI_2$) and hydrogen are added to the filling gas in the discharge vessel. Thus this lamp contains no mercury.

At technically controllable wall temperatures up to about 900°C elemental iron has a vapour pressure too low to be efficiently used in an iron spectral lamp of the type concerned. For this reason the discharge vessel contains iron iodide the vapour pressure of which is much higher than that of iron. The iron iodide may be introduced in the solid state in the form of $FeI_2$ or as Fe and $I_2$ in a corresponding stoichiometric ratio.

Such a lamp is ignited in the usual manner by means of a noble gas, for example argon and/or krypton. The operating voltage of an arc produced in this manner and hence the power that can be supplied and the maximum attainable wall temperature of the discharge vessel, however, generally are so low that even the iron iodide is insufficiently vaporized. However, sufficient vaporization of the $FeI_2$ is a prerequisite for a sufficient supply or excitable iron in the lamp. It is true that the power which can be supplied can be increased by the addition of mercury, however, this would cause undesirable broadening or shifting of the iron spectral lines. Furthermore the undesirable mercury spectrum would be produced. According to the invention the wall temperature of the discharge vessel is given the value necessary for quantitative vaporisation of the iron iodide (about 500°C to 600°C) by the addition of a small amount of hydrogen, the iron lines not being perceptibly affected.

It should be mentioned that it is known to introduce hydrogen into high pressure gas discharge lamps which apart from a noble gas contain mercury only, for the purpose of increasing the thermal conductivity (Austrian Patent Specification No. 196,503).

Preferably the amount of the added iron iodide is from 0.1 to 5 micromoles per $cm^3$ of the volume of the discharge chamber and the hydrogen pressure is from 0.05 to 2 torr. In operation such a lamp has an overall pressure of about 100 to 1,000 torr.

To prevent hydrogen from escaping from the lamp by diffusion the discharge vessel may be accommodated in known manner in an outer envelope. In an advantageous further embodiment of such a lamp according to the invention the outer envelope contains hydrogen at a pressure of from 0.3 to 20 torr. This ensures that at the operating temperature the partial hydrogen pressures in the discharge vessel and in the outer envelope are substantially equal.

To prevent electric breakdowns in the outer envelope, this may further contain a quenching gas, preferably nitrogen, at a pressure between 10 and 1,000 torr.

To enable the ultraviolet spectral lines of the iron to emerge, the outer envelope may entirely or partly consist of a material which transmits ultraviolet, for example quartz.

An embodiment of the invention will now be described, by way of example, with reference to the accompanying diagrammatic drawing the single FIGURE of which is a schematic sectional view of a discharge lamp according to the invention.

A quartz discharge vessel 1 encloses two tungsten electrodes 2 which are connected to current supply leads 4 and 5 by molybdenum lead-ins 3. The discharge vessel 1 is accommodated in an outer envelope 6 of vitreous silica.

The inner diameter of the discharge vessel 1 is 15 mm and its volume is 7 $cm^3$. The spacing between the electrodes 2 and hence the length of the arc is 4 cm. The arc struck between the electrodes 2 has a diameter of about 1.5 mm.

In the cold state the filling of the discharge vessel 1 consists of:

1 micromole/$cm^3$ of $FeI_2$
argon at a pressure of 20 torr
$H_2$ at a pressure of 0.25 torr.

The filling of the outer envelope 6 in the cold state consists of:

$H_2$ at a pressure of 2 torr
$N_2$ at a pressure of 400 torr.

The lamp is operated at an alternating voltage of 95 $V_{eff}$ and 220 $V_{peak}$ and consumes a power of 110 W. The useful life of the lamp is 500 hours.

By means of such a lamp intensive iron spectral lines were produced without contamination in the line spectrum (not even from iodine or hydrogen). The half-value width and the shift of the spectral lines were less than 0.025 A. Hence the lamp can be used as a wavelength standard in the spectral range between 200 nm and 1,000 nm. What is claimed is

1. Metal iodide vapour discharge lamp comprising a discharge vessel which contains a noble gas for starting, a metal and iodine in an amount equivalent to that of the metal, characterized in that in order to obtain an iron spectral lamp the discharge vessel contains iron iodide ($FeI_2$) and hydrogen.

2. Lamp as claimed in claim 1, characterized in that the amount of iodide is from 0.1 to 5 micromoles per $cm^3$ of the volume of the discharge chamber and in that the hydrogen pressure is from 0.05 to 2 torr.

3. Lamp as claimed in claim 2 in which the discharge vessel is disposed in an outer envelope, characterized in that the outer envelope contains hydrogen at a pressure of from 0.3 to 20 torr.

4. Lamp as claimed in claim 3, characterized in that the outer envelope further contains a quenching gas at a pressure between 10 and 1,000 torr.

5. Lamp as claimed in claim 4, characterized in that the quenching gas is nitrogen.

* * * * *

UNITED STATES PATENT AND TRADEMARK OFFICE

CERTIFICATE OF CORRECTION

PATENT NO. : 3,947,714

DATED : March 13, 1976

INVENTOR(S) : LUDWIG REHDER ET AL

It is certified that error appears in the above-identified patent and that said Letters Patent are hereby corrected as shown below:

IN THE TITLE PAGE

Below Section [76] it should read

--[73] Assignee: U. S. PHILIPS CORPORATION, New York, N.Y.--

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*